United States Patent [19]

Kroll

[11] Patent Number: 4,621,855

[45] Date of Patent: Nov. 11, 1986

[54] CARRYING HANDLE

[76] Inventor: Holgar Kroll, Striepentwiete 21, 2104 Hamburg 92, Fed. Rep. of Germany

[21] Appl. No.: 689,946

[22] Filed: Jan. 9, 1985

[30] Foreign Application Priority Data

Jan. 13, 1984 [DE] Fed. Rep. of Germany ..... 3400944

[51] Int. Cl.[4] ..... A47G 25/06

[52] U.S. Cl. ..... 294/171; 294/137

[58] Field of Search ..... 294/171, 172, 173, 170, 294/137; 220/95 D; 190/57; 150/12

[56] References Cited

U.S. PATENT DOCUMENTS 454,105 6/1891 Anderson ..... 294/171

3,578,226 5/1971 Good ..... 294/137

FOREIGN PATENT DOCUMENTS 761947 11/1956 United Kingdom ..... 294/170

*Primary Examiner*—James B. Marbert

*Attorney, Agent, or Firm*—Cushman, Darby & Cushman

[57] ABSTRACT

A carrying handle for carrier bags comprises a plastic rod or bar bent in its central area to form an open ring whose central axis is parallel to the two ends of the plastic rod which has a common longitudinal axis and which is open in the transition area to the two bar ends.

6 Claims, 5 Drawing Figures

CARRYING HANDLE

BACKGROUND OF THE INVENTION

1. Field of the Invention

The invention relates to a carrying handle for carrier bags, such as those having loop handles or straps, and comprises a plastic part bent in its central area to form an open ring receiving the carrier bags.

2. Description of the Prior Art

A carrying handle of this type is known from German Utility Model No. 7,039,491. It has a grip area with an open ring in the plane of the grip area. The disadvantage of this carrying handle is that its ring is in the vicinity of the plane of the grip or handle. Carrier bags hanging freely in the ring always turn in such a way that the central axis of the grip hole of the bag is positioned perpendicularly on the central axis of the ring, i.e., the ring is perpendicular to the hanging bag. If plastic bags are carried with this carrying handle, they do not hang parallel to the direction of movement of the user and are instead at right angles thereto. Thus, when walking they stroke against the body and twist. This also leads to twisting of the handles of the bags, so that they easily tear off. In addition, the load on the bag handle is not distributed over a specific area as is the case when a person is carrying the bag in the hand. The handles of conventional plastic carrier bags are not designed for such loading with additional twisting. In addition, it is unpleasant to carry several bags, which constantly strike against the body or legs of the user, resulting in twisting and therefore easy tearing. Finally, the grip area of the known carrying handle has a predetermined size and as it is naturally given a small size, it is too large for small hands and can easily slip, or is too small for large hands and can therefore easily cut the person's hand.

SUMMARY OF THE INVENTION

The problem of the invention is to improve a carrying handle in such a way that it is pleasantly received in the hand and also makes it possible to comfortably and reliably carry several carrier bags.

The present invention provides a carrying handle enabling carrier bags to be carried comfortably and reliably because, through the arrangement of the open ring with respect to the rod ends serving as the grip, the handles of the hanging bags are not twisted during use, so that these bags do not hinder the user when carrying them and the bag handles are not twisted and do not become overloaded. In addition, the carrying handle according to the invention can be manufactured simply and in a material-saving manner.

BRIEF DESCRIPTION OF THE DRAWINGS

The invention is described in greater detail hereinafter relative to the drawings which show in.

DETAILED DESCRIPTION OF THE PREFERRED EMBODIMENTS

Figure 1:
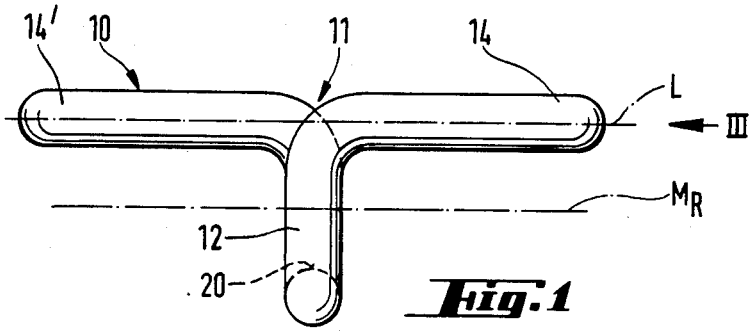
FIG. 1, a side view of the carrying handle.
Figure 2:
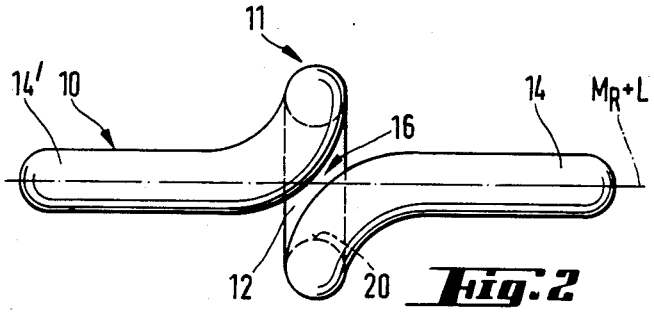
FIG. 2, a plan view of the carrying handle.
Figure 3:
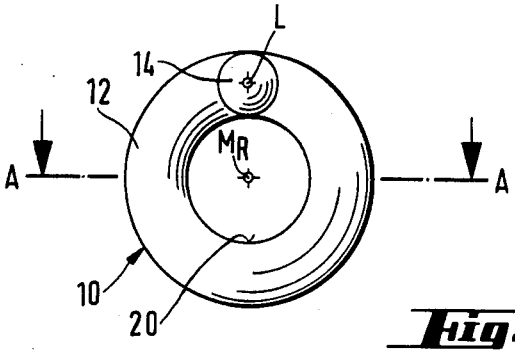
FIG. 3, an end view of the carrying handle.

The carrying handle shown in FIGS. 1 to 3 comprises a plastic rod 10, which is preferably made from a thermoplastic material. In the central area 11 of said rod 10, it is bent to form an open ring 12, that is, there is a gap provided in the ring 12. The ring 12 has a central axis $M_R$ which is parallel to the two ends 14, 14' of the plastic rod located on a common longitudinal axis L. Ring 12 is open in the transition area 16 to the two rod ends 14, 14'.

In use, the grip openings of carrier bags are inserted into this transition area or gap 16, which can be referred to as the ring opening. The grip openings of the carrier bags rest on the supporting part 20 of the ring 12, which part 20 diametrically faces the ring opening or transition area 16 between the two rod ends 14, 14'. A number of carrier bags can be introduced through the gap 16 into the open ring 12 and the grip openings of the carrier bags are held together by ring 12. During carrying, one of the two rod ends 14, 14' is located on the small finger and the other rod end is located on the fore finger of the hand.

Preferably, the gap in the open ring area is 2 to 8 mm. This distance is sufficient to permit the successive insertion of several carrier bags into the carrying handle ring.

Figure 4:
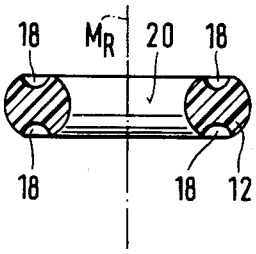
FIG. 4, a section through the carrying handle in plane A—A of FIG. 3.

The carrying handle according to the invention can either be produced from a rod by shaping it around a core or by the injection moulding process. It is appropriate to facilitate removal of the carrying handle from the injection mould and to same material for the two sides of the open ring, running parallel to a plane positioned perpendicularly on the ring central axis $M_R$, by forming one or more flattened portions or channels 18, as shown in FIG. 4.

The carrying handle can comprise a solid plastic rod with a preferably circular cross-section. The ends of the plastic rod 14 or 14' can be roughened or provided with longitudinal grooves to give a better grip.

It is also appropriate to provide flattened portions 22 on at least one of the rod ends 14 or 14' in an area remote from the axis $M_R$ and these portions 22 can receive markings that do not impede carrying.

Figure 5:
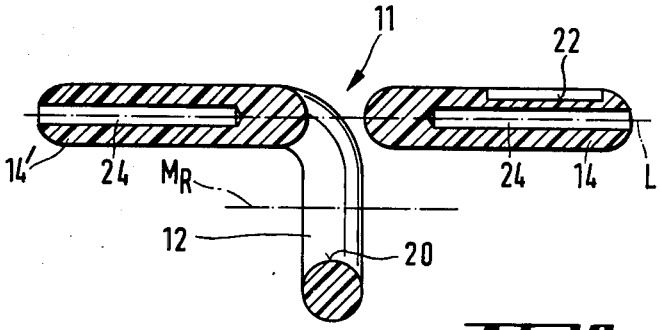
FIG. 5, a longitudinal section through a carrying handle similar to FIG. 1 in a modified form.

For material saving reasons, it is also appropriate for the bar ends 14 and 14' to have at least partly hollow interior 24, as shown in FIG. 5.

According to a particularly preferred carrying handle, the total length is approximately 9 to 12 cm and preferably 10 cm, for a plastic bar diameter of 0.8 to 1.2 cm and a ring diameter of approximately 2 to 2.5 cm, with an inside diameter of 2 cm. Obviously, other modifications are also possible.

What is claimed is:

1. A carrying handle for at least one carrier bag having a strap-like carrying loop, comprising:

a rod having a center and a longitudinal axis therethrough;

two ends being coaxially aligned on the longitudinal axis of the rod and facing in opposite directions from each other;

an open ring formed in the center of the rod in a plane perpendicular to the longitudinal axis of said rod, said open ring having a central opening therein with a central axis parallel to but spaced from the longitudinal axis of the rod and aligned perpendicular to the plane of the open ring; and an open transition area, located in the juncture of the open ring and the longitudinal axis of the rod, for allowing the strap-like carrying loop of the at least one carrier bag to be slipped therethrough for hanging from the open ring formed in the center of the rod so that the at least one carrier bag is supported therefrom.

2. Carrying handle according to claim 1, characterized in that the transition area of the open ring extends a distance of 2 to 8 mm.

3. Carrying handle according to claim 1, characterized in that flattened portions for receiving markings are provided on at least one of the ends of the rod in an area remote from the central axis of the ring.

4. Carrying handle according to claim 1 characterized in that the rod has a circular cross-section.

5. Carrying handle according to claim 1, characterized in that the ends of the rod are roughened or grooved on the surface.

6. Carrying handle according to claim 1, characterized in that the ends of the rod are hollow.

* * * * *